US010832632B2

(12) United States Patent
Amirkhany

(10) Patent No.: US 10,832,632 B2
(45) Date of Patent: Nov. 10, 2020

(54) LOW POWER ARCHITECTURE FOR MOBILE DISPLAYS

(71) Applicant: Samsung Display Co., Ltd., Yongin (KR)

(72) Inventor: Amir Amirkhany, Sunnyvale, CA (US)

(73) Assignee: Samsung Display Co., Ltd., Yongin (KR)

( * ) Notice: Subject to any disclaimer, the term of this patent is extended or adjusted under 35 U.S.C. 154(b) by 0 days.

(21) Appl. No.: 16/271,511

(22) Filed: Feb. 8, 2019

(65) Prior Publication Data

US 2019/0287479 A1 Sep. 19, 2019

Related U.S. Application Data

(60) Provisional application No. 62/643,117, filed on Mar. 14, 2018.

(51) Int. Cl.
*G09G 5/00* (2006.01)
*G09G 5/04* (2006.01)

(52) U.S. Cl.
CPC ..... *G09G 5/006* (2013.01); *G09G 5/04* (2013.01); *G09G 2310/08* (2013.01); *G09G 2340/02* (2013.01); *G09G 2360/128* (2013.01); *G09G 2360/18* (2013.01); *G09G 2370/00* (2013.01)

(58) Field of Classification Search
CPC ..... G09G 5/006; G09G 5/04; G09G 2310/08; G09G 2340/02; G09G 2360/128; G09G 2360/18; G09G 2370/00
USPC ..... 345/204, 210
See application file for complete search history.

(56) References Cited

U.S. PATENT DOCUMENTS

| | | | | |
|---|---|---|---|---|
| 7,834,869 | B2 | 11/2010 | Kondo et al. | |
| 9,001,017 | B2 | 4/2015 | Moon et al. | |
| 9,082,364 | B2 | 7/2015 | Lin et al. | |
| 9,307,248 | B2 * | 4/2016 | Wu | H04N 19/129 |
| 9,514,705 | B2 | 12/2016 | Ju et al. | |
| 9,767,766 | B2 | 9/2017 | Oh et al. | |
| 9,824,660 | B2 | 11/2017 | Park et al. | |
| 9,830,872 | B2 | 11/2017 | Kim | |
| 2004/0239655 | A1 | 12/2004 | Tani et al. | |
| 2005/0219193 | A1 | 10/2005 | Nagaoka et al. | |
| 2007/0013774 | A1 * | 1/2007 | Maeng | G02F 1/13306 348/87 |
| 2011/0095804 | A1 * | 4/2011 | Kumar | H03K 19/018521 327/333 |

(Continued)

OTHER PUBLICATIONS

Office action issued in U.S. Appl. No. 16/271,542 by the USPTO, dated Sep. 19, 2019, 38 pages.

(Continued)

*Primary Examiner* — Jacinta M Crawford
(74) *Attorney, Agent, or Firm* — Lewis Roca Rothgerber Christie LLP

(57) ABSTRACT

A low power architecture for mobile displays includes a display, a low voltage integrated circuit configured to: receive a high speed input signal; process the input signal; and output uncompressed pixel data based on the processed input signal; and a high voltage integrated circuit configured to drive pixels in the display based on the uncompressed pixel data; wherein the low voltage integrated circuit is configured to provides the uncompressed pixel data to the high voltage integrated circuit via a timing-to-driver (T2D) interface.

20 Claims, 9 Drawing Sheets

(56) References Cited

U.S. PATENT DOCUMENTS

| | | | | |
|---|---|---|---|---|
| 2013/0241960 | A1* | 9/2013 | Xu | G09G 3/3614 345/690 |
| 2014/0091998 | A1* | 4/2014 | Ko | G09G 3/3674 345/100 |
| 2016/0188062 | A1 | 6/2016 | Jung et al. | |
| 2016/0203802 | A1* | 7/2016 | Hong | G09G 5/006 345/534 |
| 2016/0275893 | A1 | 9/2016 | Tanaka et al. | |
| 2016/0345022 | A1 | 11/2016 | Ju et al. | |
| 2017/0069289 | A1* | 3/2017 | Oh | H04N 5/44 |
| 2017/0187551 | A1* | 6/2017 | Lukanc | H04L 25/03019 |
| 2017/0308226 | A1 | 10/2017 | Yoo et al. | |

OTHER PUBLICATIONS

U.S. Notice of Allowance dated Jun. 25, 2020, issued in U.S. Appl. No. 16/271,542 (10 pages).

* cited by examiner

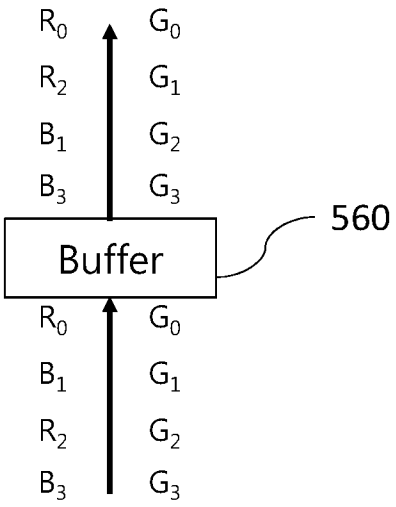
Figure 5A
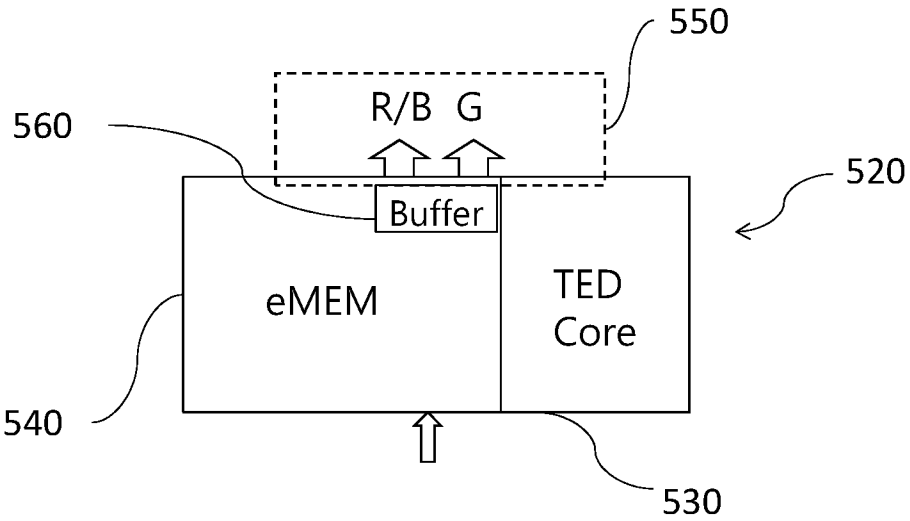

LOW POWER ARCHITECTURE FOR MOBILE DISPLAYS

CROSS-REFERENCE TO RELATED APPLICATION(S)

The present application claims priority to and the benefit of U.S. Provisional Patent Application No. 62/643,117 filed on Mar. 14, 2018, the content of which is incorporated herein by reference in its entirety. This application is further related to U.S. patent application Ser. No. 16/271,542, filed Feb. 8, 2019, the entire content of which is incorporated herein by reference.

BACKGROUND

1. Field

One or more aspects of embodiments disclosed herein relate to a system and method for a display interface.

2. Description of Related Art

Displays for mobile devices continue to become increasingly capable with each successive generation. Generally, each generation has higher resolutions, greater color space, increased brightness, and increased contrast ratios. For example, the number of pixel columns in a display has increased from 1080 columns in FullHD displays to 2160 columns in 4 k displays to 4360 columns in 8 k displays.

Generally, in a mobile device display, the columns are driven by an integrated circuit (e.g. a Source IC). As mobile device display technology has evolved with each generation, there has been an increased demand for additional memory. The additional memory may be needed for a variety of different purposes such as for supporting a higher resolution, supporting a larger color space, compensating for the uniformity of the pixels, and/or for frame buffering for power savings. In some architectures, the additional memory is introduced using a separate chip. However, a separate memory chip can be problematic because it can be high power. A new architecture is therefore desired to avoid the need for an additional memory chip that utilizes space and additional space.

Newer generations of processors such as Timing Controller Embedded Driver Integrated Circuits (TEDs) can be useful. The TED is a chip within a display that receives the video stream from an application processor and drives the pixel on a display. It has high-voltage driving at the output and a serial interface at the input, which delivers the video. Also, the TED performs signal processing and deserialization and then converts to high voltage and drives the pixel.

In addition, TEDs may use large first-in, first-out (FIFO) data buffers. The buffer size is dependent on the resolution and color resolution of a display along with compression. For example, an 8 bit display (e.g., 24 bits for each pixel and 8 bits for each of the red, blue and green sub-pixels) with a 1440×3040 resolution may require 1440×3040×24×⅓ (Display Stream Compression)=33.4 Megabytes (MB) of space to store a single frame. As resolution increases, the size of the buffer also increases and there may be no physical space or budget for the increasingly large buffer.

The above information disclosed in this Background section is only for enhancement of understanding of the background and therefore it may contain information that does not constitute prior art.

SUMMARY

Aspects of embodiments of the present disclosure are directed toward a system and method for a low power architecture for mobile displays.

According to some embodiments of the present disclosure, in a display architecture includes a display, a low voltage integrated circuit configured to: receive a high speed input signal; process the input signal; and output uncompressed pixel data based on the processed input signal; and a high voltage integrated circuit configured to drive pixels in the display based on the uncompressed pixel data; wherein the low voltage integrated circuit is configured to provides the uncompressed pixel data to the high voltage integrated circuit via a timing-to-driver (T2D) interface.

According to some example embodiments, the high speed input signal includes an encoded input signal.

According to some example embodiments, the T2D interface includes a parallel interface.

According to some example embodiments, the low voltage integrated circuit includes an embedded memory manager (eMEM) and a processor.

According to some example embodiments, the low voltage integrated circuit is manufactured using a first process and the high voltage integrated circuit is manufactured using a second process.

According to some example embodiments, the processor includes a Timing Controller Embedded Driver Integrated Circuit (TED) core.

According to some example embodiments, wherein the embedded memory manager includes at least one of an embedded Dynamic Random-Access Memory (eDRAM) or an embedded Magnetoresistive Random Access Memory (eMRAM).

According to some example embodiments, the first process is more advanced than the second process.

According to some example embodiments of the present disclosure, a method for transmitting pixel data in a display including transmitting, by a transmitter side of a low voltage integrated circuit, uncompressed pixel data on a data bus; and receiving, by a receiver side of a high voltage integrated circuit, the uncompressed pixel data from a low voltage integrated circuit, wherein the data bus includes an unterminated connection at the receiver side.

According to some example embodiments, the uncompressed pixel data includes red-green-blue (RGB) data.

According to some example embodiments, the uncompressed pixel data includes red-green-blue-green (RGBG) data.

According to some example embodiments, transmitting pixel data includes transition encoding uncompressed pixel data at the transmitter side; decoding uncompressed pixel data at the receiver side.

According to some example embodiments, transmitting pixel data includes separating, by a buffer in the transmitter side, red/blue (R/B) pixel data of the RGBG data into a first color stream and green (g) pixel data of the RGBG data into a second color stream; reordering, by the buffer in the transmitter side, the R/B pixel data of the first color stream such that same colors of the R/B pixel data appear consecutively; transmitting, by the buffer in the transmitter side, the first color stream and the second color stream to a second buffer in the receiver side; reordering, by the second buffer in the receiver side, the R/B pixel data of the first color stream such that the colors of the R/B pixel data appear in the original order.

According to some example embodiments of the present disclosure, in a method for transmitting uncompressed red-green-blue-green (RGBG) pixel data across an interface of a display includes: separating, by a buffer of a low voltage integrated circuit, red/blue (R/B) pixel data of the uncompressed RGBG pixel data into a first color stream and green (g) pixel data of the uncompressed RGBG pixel data into a second color stream; reordering, by the buffer of the low voltage integrated circuit, the RIB pixel data of the first color stream such that same colors of the R/B pixel data appear consecutively; transmitting, by the buffer of the low voltage integrated circuit, the first color stream and the second color stream to a receiver side of the interface; carrying, by the interface, the first color stream and the second color stream from the receiver side of the interface to a transmitter side of the interface; and transmitting, by the transmitter side of the interface, the first color stream and the second color stream to a high voltage integrated circuit.

According to some example embodiments, transmitting uncompressed RGBG pixel data across an interface of a display includes storing, by the high voltage integrated circuit, the first color stream and second color stream in a buffer of the high voltage integrated circuit; reordering, by the buffer of the high voltage integrated circuit, the R/B pixel data of the first color stream such that the colors of the R/B pixel data are in an original order; driving, by the high voltage integrated circuit, the first color stream and the second color stream to a display.

According to some example embodiments, the interface includes a Timing-to-Driver (T2D) interface.

According to some example embodiments, the low voltage integrated circuit includes an embedded memory manager (eMEM) and a processor.

According to some example embodiments, the low voltage integrated circuit is manufactured using a first process and the high voltage integrated circuit is manufactured using a second process.

According to some example embodiments, the processor includes a Timing Controller Embedded Driver Integrated Circuit (TED) core.

According to some example, embodiments, the first process is more advanced than the second process.

BRIEF DESCRIPTION OF THE DRAWINGS

Some embodiments can be understood in more detail from the following description taken in conjunction with the accompanying drawings, of which:

FIG. 5A shows a system diagram of the LV chip 520 and the interface 550 according to another embodiment.

DETAILED DESCRIPTION

In various embodiments, a low power mobile display architecture may include a hybrid display panel interface that utilizes integrated circuits that include different process technologies (e.g., a 65 nm low voltage process and a 130 nm high voltage process). In various embodiments, the integrated circuits are connected by a parallel interface between them. In various embodiments, a first integrated circuit includes an input interface configured to connect to and receive display data from an application processor. In various embodiments, the first integrated circuit was constructed using a more advanced process such as 65 nm or less semiconductor process. In various embodiments, the first integrated circuit includes an output parallel interface for relaying pixel data, via the parallel interface, to the second integrated circuit. In various embodiments, the first integrated circuit is configured to reorder the individual pixels of the pixel data such that the pixels of the same color are relayed in consecutive order. In various embodiments, the first integrated circuit is configured to invert the pixel data using data bit inversion encoding techniques. In various embodiments, the parallel interface is configured to carry uncompressed pixel data between the first integrated circuit and the second integrated circuit. In various embodiments, the parallel interface is un-terminated at the receiver side, is low swing, and at any instance in time includes sub-pixel data. In various embodiments, the second integrated circuit receives the pixel data from the first integrated circuit via the parallel interface and outputs the pixel data to the display panel columns using pixel drivers. In various embodiments, the second integrated circuit was constructed using a less advanced process such as 130 nm semiconductor process.

Figure 1:
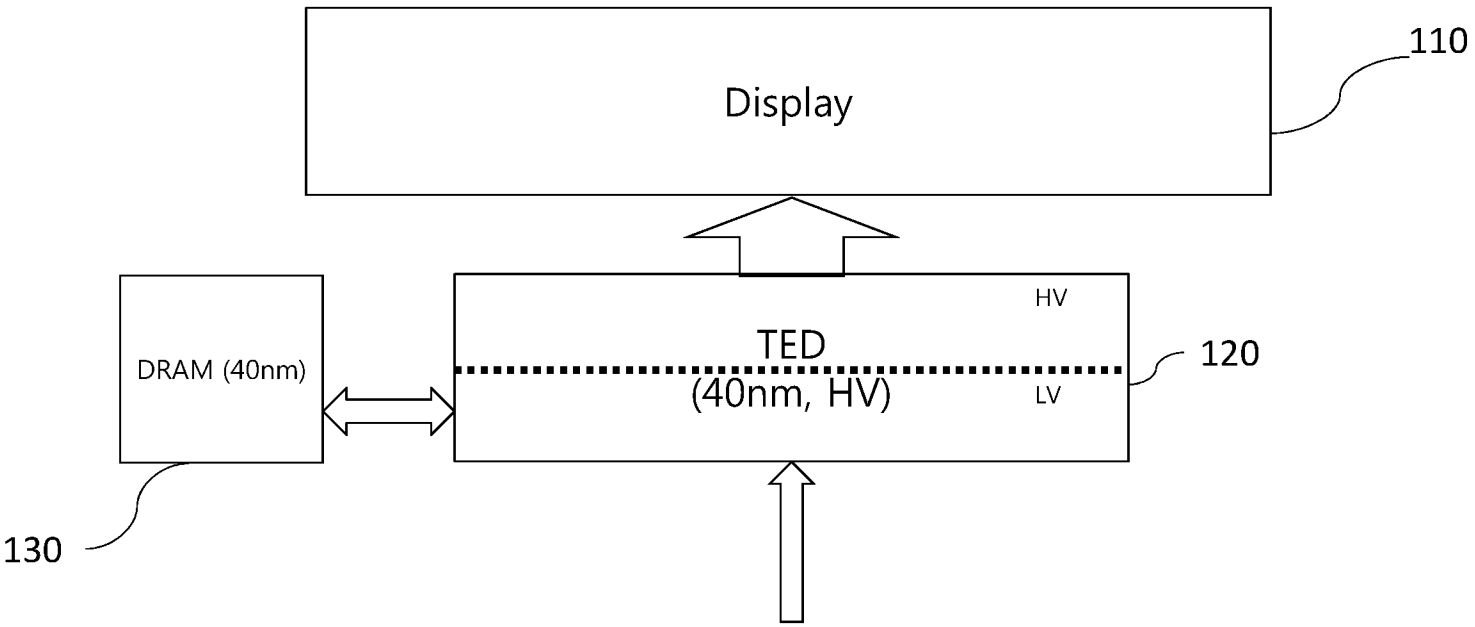
FIG. 1 is a system diagram of a display architecture for a mobile device with external DRAM.

FIG. 1 is a system diagram of a display architecture for a mobile device with external DRAM.

Referring to FIG. 1, the display architecture may contain a Timing Controller Embedded Driver Integrated Circuit (TED) 120 chip configured to receive a video stream from a processor (e.g., an application processor) and drive the pixels on an attached display 110. In some embodiments, the video stream may be an encoded signal (e.g. compressed signal). The TED 120 is usually manufactured using a semiconductor process that is optimized for high-voltage (HV) driving (e.g., for driving the pixels). The TED 120, however, also includes a low-voltage (LV) serial interface at its input. The process typically used on a TED 120 is not optimal for the serial interface or for embedded memory, etc. In some instances, the TED 120 is also connected to an external memory 130. Interfacing with the memory 130 involves a bidirectional, high speed, and relatively high power interface that is not desirable low power applications (e.g., mobile devices or any display with power constraints).

Figure 2:
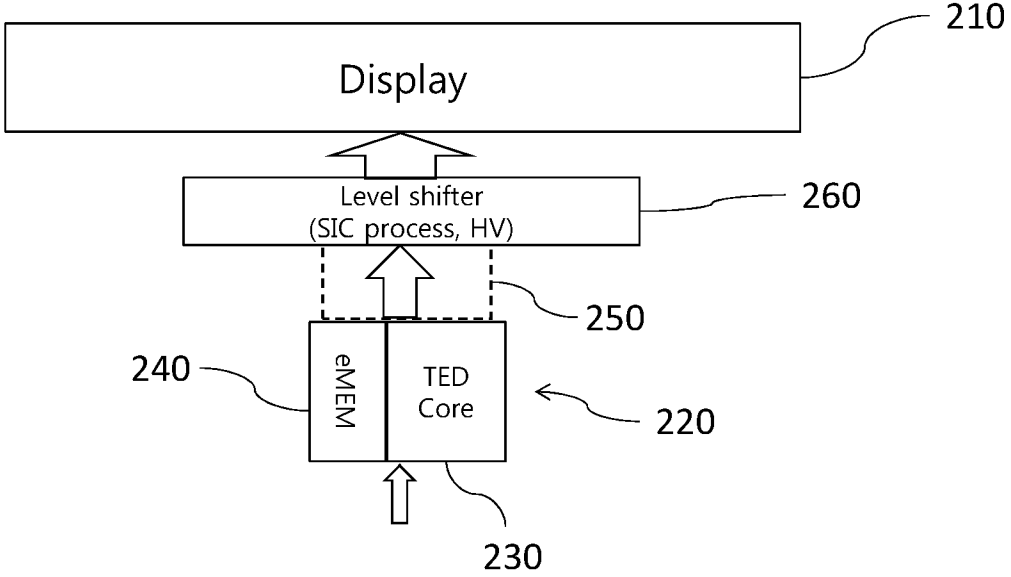
FIG. 2 illustrates a system diagram of a display architecture for a mobile device according to one embodiment of the present disclosure.

FIG. 2 illustrates a system diagram of a display architecture for a mobile device according to one embodiment of the present disclosure.

Referring to FIG. 2, in various embodiments, the display architecture incorporates separate integrated circuits for signal processing and driving the pixels of the signal onto the display. In various embodiments, the integrated circuits include a high voltage (HV) chip 260 and a low voltage (LV)

chip 220. In various embodiments, the high voltage chip has transistors capable of tolerating supply levels necessary for driving pixels in a range of 5-8 volts. In various embodiments, the low voltage chip is the supply voltage of generic processes that are in a range of 1.0-1.2 volts. According to various embodiments, the HV chip 260 is coupled to a display 210 and to the LV chip 220 via an interface 250. The LV chip 220 is configured to receive display data from an external source (e.g., an application processor). In some embodiments, the display data may be an encoded signal (e.g. compressed signal). The LV chip 220 processes the incoming display data and sends information to the HV chip 260 using the interface 250. In some embodiments, the LV chip 220 may do some pixel processing and compensation on the incoming pixels. The HV chip 260 then drives the pixels of the display. In various embodiments, the HV chip 260 is integrated on the glass of the display 210.

According to various embodiments, the signal processing is performed at the LV chip 220. The LV chip 220 includes an embedded memory manager (eMEM) 240 and a Timing Controller Embedded Driver Integrated Circuit (TED) core 230. In some embodiments, the eMEM may be an embedded Dynamic Random-Access Memory (eDRAM) or an embedded Magnetoresistive Random Access Memory (eMRAM). By including the TED 230 and the eMEM 240 on the same chip, the need to transmit a high power signal back and forth between the TED and external memory component as discussed with reference to FIG. 1 is eliminated.

In various embodiments, the TED 230 of the LV chip 220 receives a signal from an application processor at its input. In various embodiments, the signal may be an encoded signal (e.g. compressed signal). In various embodiments, the signal includes video data, which generally includes sub-pixel data. The sub-pixel data may include, but is not limited to, red-green-blue (RGB), red-green-blue-green (RGBG), red-green (RG), and red (R) sub-pixel data. After receiving the signal, the TED 230 processes the signal. In some cases, the signal processing at the TED 230 may require access to memory. In this embodiment, the TED 230 utilizes the eMEM 240. The TED 230 sends the signal to the eMEM 240, where the signal is stored temporarily. Subsequently, the TED 230 retrieves the stored signal from the eMEM 240.

After retrieving the stored signal, the TED 230 transmits the uncompressed signal to the HV chip 260 through the interface 250. The HV chip 260 serves as a level shifter and contains pixel drivers. After receiving the signal, the HV chip 260 increases the voltage of the signal to a higher voltage in order to drive the pixels onto the display 210.

According to this embodiment, the signal processing and driving steps are more cost and power efficient. The TED process is a specialized process that has to be able to drive high voltage signals and also support fast low voltage logic. Splitting the TED process onto two separate chips allows for the high voltage steps and low voltage steps to be placed on separate chips. The low voltage chip can be constructed using more advanced processes such as 65 nm or less semiconductor process. The high voltage chip is simply a level chip that can be constructed using older technologies (e.g. less advanced technologies) such as less than 30 nm or 28 nm processes. The low voltage chip incorporates an embedded memory process, which is less expensive to manufacture than a custom produce DRAM, as shown in FIG. 1.

In addition, in various embodiments, the interface 250 is configured to provide additional power savings. Unlike the interface between the TED 120 and the DRAM 130 of FIG. 1, the interface 250 is unidirectional and is low-speed parallel. Using the interface 250 may reduce power consumption by half when compared to the display architecture described in FIG. 1.

In some embodiments, the interface 250 may be a timing-to-driver (T2D) interface. The interface 250 carries the signal uncompressed from the LV chip 220 to the HV chip 260. The interface 250 may be short-reach because the HV chip 260 and the LV chip 220 may be very close in proximity to each other. The interface 250 may be configured to reduce power consumption by allowing the pixels to be un-terminated and thus the power consumption may be proportional with the image content shown on the display 210.

In some embodiments, the interface 250 provides additional advantages. For example, the interface 250 may have reduced or no addressing overhead and can have low overhead clocking. The interface 250 per-pin data rate may be less than about 2 Mb/s to relax constraints on the HV chip 260. The interface 250 is un-terminated at the receiver side and is low swing. The interface 250 can be either differential or single-ended, however, in some embodiments a single-ended solution may be preferable. Additionally, the interface 250 can be configured to carry uncompressed sub-pixel data. In some embodiments, the sub-pixel data may include, but is not limited to, red-green-blue (RGB), red-green-blue-green (RGBG), red-green (RG), red (R).

Figure 3A:
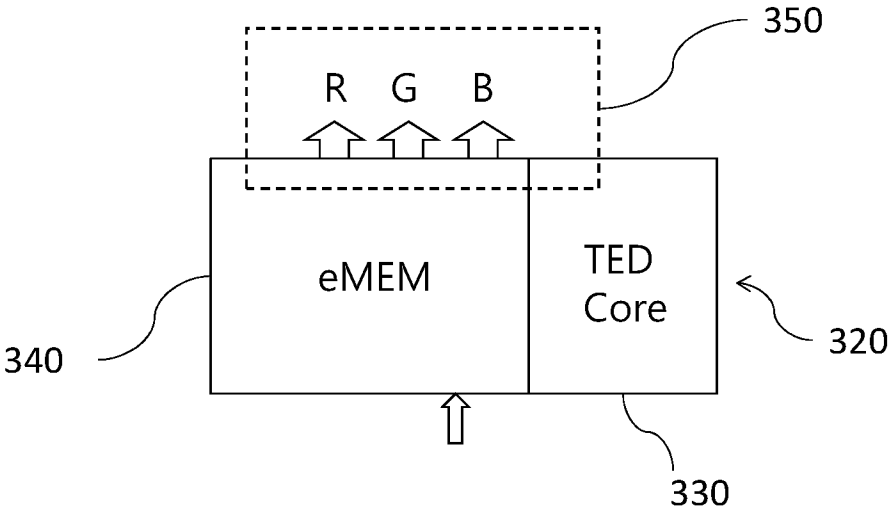
FIG. 3A shows a system diagram of the LV chip 320 and the interface 350 according to one embodiment.

FIG. 3A shows a system diagram of the LV chip 320 and the interface 350 according to one embodiment.

Referring to FIG. 3A, the LV chip 320 is part of a larger display architecture as described in FIG. 2. According to this embodiment, the display architecture incorporates a red-green-blue (RGB) display (e.g., a RGB stripe display). However, in other embodiments, a different display type may be used (e.g., a red-green-blue-white (RGBW) display, a red-green-blue-green (RGBG) display, or any other display type).

In this embodiment, the LV chip 320 is coupled to an HV chip via the interface 350. In some embodiments, the interface 350 may be a timing-to-driver (T2D) interface. The LV chip 320 includes an embedded memory manager (eMEM) 340 and a Timing Controller Embedded Driver Integrated Circuit (TED) core 330.

Figure 3B:
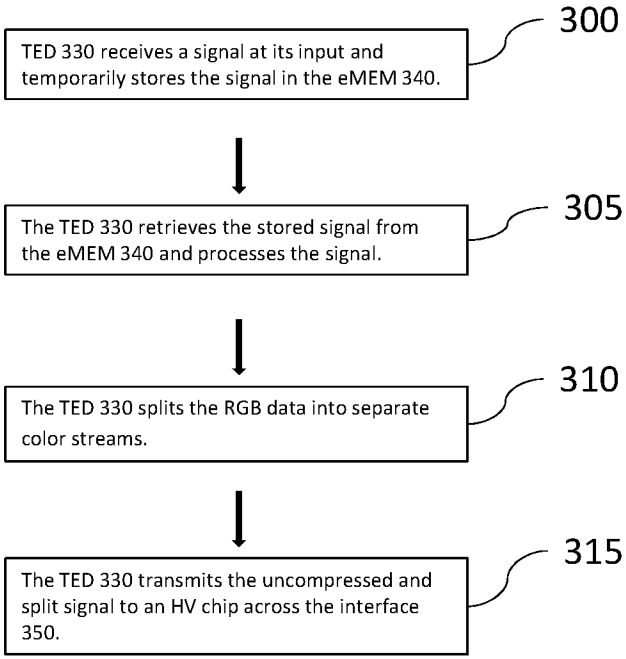
FIG. 3B displays a flow diagram illustrating the transmission of a signal through the architecture shown in FIG. 3A.

FIG. 3B displays a flow diagram illustrating the transmission of a signal through the architecture shown in FIG. 3A.

The LV chip 320 is configured to receive a signal from an application processor at its input. In Step 300, the TED 330 of LV chip 320 receives the signal. In various embodiments, the signal may be an encoded signal (e.g. compressed signal). In some embodiments, the TED 330 may temporarily store the signal in the eMEM 340 after receiving it. The signal may include video data for displaying on the RGB display. Thus, according to this embodiment, the video data may include red-green-blue (RGB) sub-pixel data. In Step 305, the TED 330 retrieves the signal from eMEM 340 and processes the signal. For example, in some embodiments, the TED 330 splits the RGB data into separate color streams as shown in Step 310. For example, for a 10-bit display (e.g., 10-bit color), the RGB data may be split from 30-bit pixel data to 10-bit sub-pixel data (e.g., $[29:0] \rightarrow \{R[9:0]\ G[9:0]\ B[9:0]\}$). After processing the signal, the TED 330 transmits the uncompressed and split signal to an HV chip across the interface 350 in Step 315. The interface 350 is single-ended, low-swing, and un-terminated.

In various embodiments, the interface 350 may be a wide interface. For example, the interface 350 may include 33 pins with 30 pins reserved for pixel data (e.g., for a 10 bit display) and 2 pins for forwarded clock (e.g., a differential clock) and one pin for reference voltage. Thus, the interface 350 may be effectively an RGB interface. In various embodiments, pixel data may be sent sequentially in rows (e.g., in a raster scan or similar pattern). Thus, when one pixel has the same output as neighboring pixel, there is no change or toggling between the first pixel and the neighboring pixel. Thus, there is little to no change in power. In various embodiments, the power consumed by the interface 350 is related to the rate at which the pixels toggle (e.g., change). Thus, the power of the interface 350 is proportional to the content of the image being displayed. For example, the power consumption of the interface 350 when an image has a uniform color image is approximately zero (e.g., there is no toggling between pixels). Similarly, the interface 350 power for a horizontally striped image is generally higher than that of a uniform image, but is also almost zero since for each line in the image there is no toggling between the pixels. The interface 350 power for the vertically striped image, however, is higher due to the pixel toggling between each column.

In various embodiments, the interface 350 may have a data rate of 1.08 Gb/s per lane (e.g., when the display has a 3K×3K resolution, a 120 Hz refresh rate, and 10 bit/color).

Figure 4A:
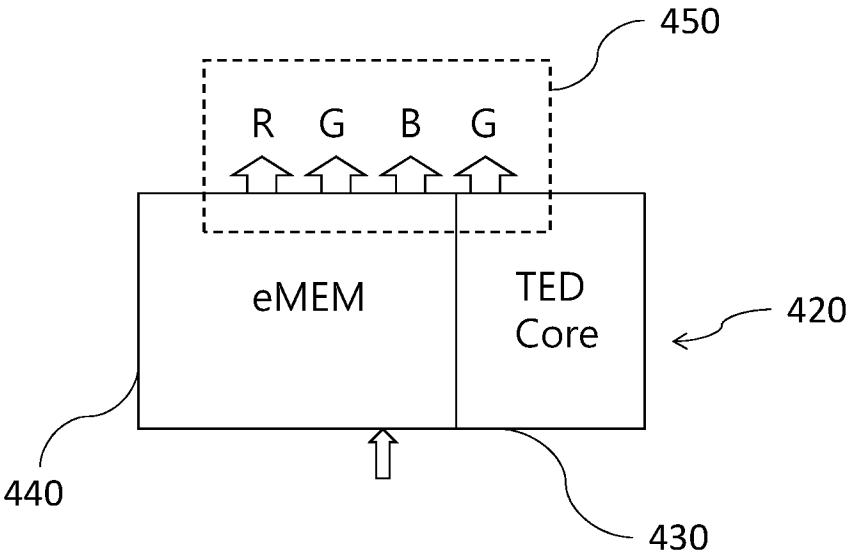
FIG. 4A shows a system diagram of the LV chip 420 and the interface 450 according to another embodiment.

FIG. 4A shows a system diagram of the LV chip 420 and the interface 450 according to another embodiment.

Referring to FIG. 4A, the LV chip 420 is part of a larger display architecture as described in FIG. 2. According to this embodiment, the display architecture incorporates a red-green-blue-green (RGBG) (e.g., Pentile) display. However, in other embodiments, a different display type may be used (e.g. a red-green-blue-white (RGBW) display, a red-green-blue (RGB) display, or any other display type).

In this embodiment, the LV chip 420 is coupled to a HV chip via the interface 450. In some embodiments, the interface 450 may be a timing-to-driver (T2D) interface. The LV chip 420 combines an embedded memory manager (eMEM) 440 and a Timing Controller Embedded Driver Integrated Circuit (TED) core 430.

Figure 4B:
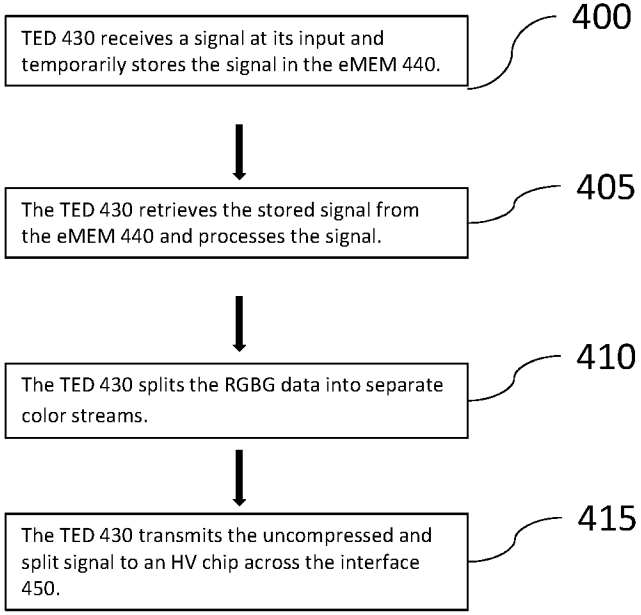
FIG. 4B displays a flow diagram illustrating the transmission of a signal through the architecture shown in FIG. 4A.

FIG. 4B displays a flow diagram illustrating the transmission of a signal through the architecture shown in FIG. 4A.

The LV chip 420 is configured to receive a signal from an application processor at its input. In various embodiments, the signal may be an encoded signal (e.g. compressed signal). In Step 400, the TED 430 of the LV chip 420 receives the signal. In some embodiments, the TED 430 may temporarily store the signal in the eMEM 440 after receiving it. The signal may include video data for displaying on the RGBG display. Thus, according to this embodiment, the video data may include red-green-blue-green (RGBG) sub-pixel data. In Step 405, the TED 430 retrieves the signal from the eMEM 430 and processes the signal. For example, in some embodiments, the TED 430 splits the RGBG data into separate color streams as shown in Step 410. For example, for a 10-bit display (e.g., 10-bit color), the RGBG data may be split from 40-bit pixel data to 10-bit sub-pixel data (e.g., [39:0]→{R[9:0] G[9:0] B[9:0] G[9:0]}). After processing the signal, the TED 430 transmits the uncompressed signal to an HV chip across the interface 450 in Step 415. The interface 450 is single-ended, low-swing, and un-terminated.

In various embodiments, the interface 450 may be a wide interface. For example, the interface 450 may include 43 pins with 40 pins reserved for pixel data (e.g., for a 10 bit display) and 2 pins for forwarded clock (e.g., a differential clock) and one pin for reference voltage. Thus, the interface 450 may be effectively an RGBG interface. In various embodiments, pixel data may be sent sequentially in rows (e.g., in a raster scan or similar pattern). Thus, when one pixel has the same output as neighboring pixel, there is no change or toggling between the first pixel and the neighboring pixel. Thus, there is little to no change in power. In various embodiments, the power consumed by the interface 450 is related to the rate at which the pixels toggle (e.g., change). Thus, the power of the interface 450 is proportional to the content of the image being displayed. For example, the power consumption of the interface 450 when an image has a uniform color image is approximately zero (e.g., there is no toggling between pixels). Similarly, the interface 450 power for a horizontally striped image is generally higher than that of a uniform image, but is also almost zero since for each line in the image there is no toggling between the pixels. The interface 450 power for the vertically striped image, however, is higher due to the pixel toggling between each column.

In various embodiments, the interface 450 may have a data rate of 0.54 Gb/s per lane (e.g., when the display has a 3K×3K resolution, a 120 Hz refresh rate, and 10 bit/color).

FIG. 5A shows a system diagram of the LV chip 520 and the interface 550 according to another embodiment.

Referring to FIG. 5A, the LV chip 520 and interface 550 are part of a larger display architecture as described in FIG. 2. According to this embodiment, the display architecture incorporates an RGBG display.

In this embodiment, the LV chip 520 may include a buffer 560 and is coupled to a HV chip via an interface 550 having a reduced width. In some embodiments, the interface 550 may be a reduced width RGBG timing-to-driver (T2D) interface.

The LV chip 520 includes an embedded memory manager (eMEM) 540 with a Timing Controller Embedded Driver Integrated Circuit (TED) core 530. Additionally, the eMEM 540 includes a buffer 560 for temporarily storing sub-pixel data.

Figure 5B:
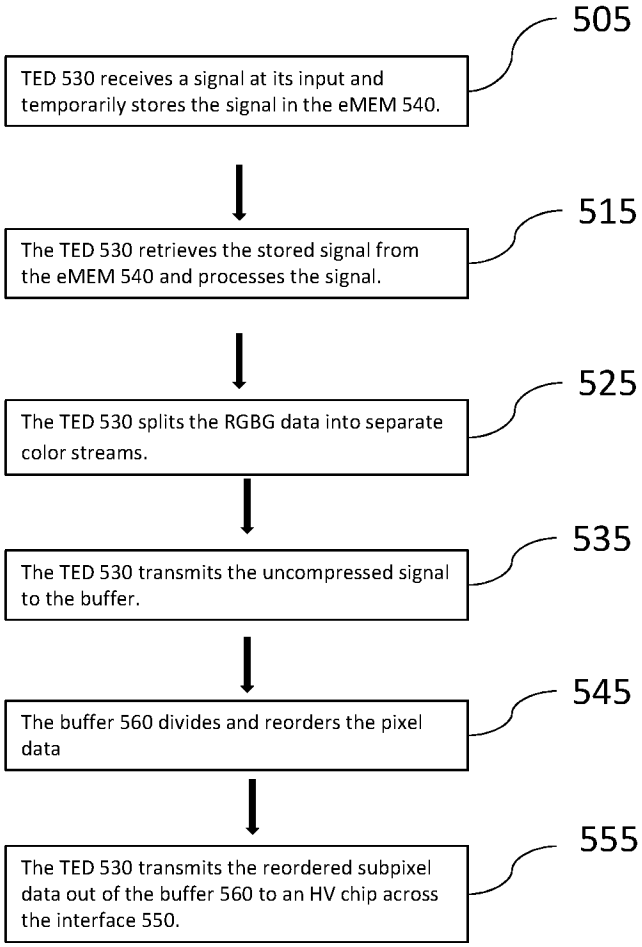
FIG. 5B displays a flow diagram illustrating the transmission of a signal through the architecture shown in FIG. 5A.

FIG. 5B displays a flow diagram illustrating the transmission of a signal through the architecture shown in FIG. 5A.

The LV chip 520 is configured to receive a signal from an application processor at its input. In various embodiments, the signal may be an encoded signal (e.g. compressed signal). In Step 505, the TED 530 of the LV chip 520 receives the signal. In some embodiments, the TED 530 may temporarily store the signal in the eMEM 540 after receiving it. The signal may include video data for displaying on the RGBG display. Thus, according to this embodiment, the video data may include red-green-blue-green (RGBG) sub-pixel data. In Step 515, the TED 530 retrieves the signal from the eMEM 430 processes the signal. For example, in some embodiments, the TED 530 splits the RGBG data into separate color streams as shown in Step 525. For example, for a 10-bit display (e.g., 10-bit color), the RGBG data may be split from 40-bit pixel data to 10-bit sub-pixel data (e.g., [39:0]→{R[9:0] G[9:0] B[9:0] G[9:0]}). In Step 535, the TED 530 transmits the uncompressed signal to the buffer 560.

In Step 545, the buffer 560 is configured to divide and reorder the pixel data and thereby reduce the size of the interface 550. For example, as described above, the RGBG interface 550 may include 40 pins [39:0]. In various embodiments, the buffer 560 may be utilized (along with a corresponding buffer in the HV chip) along with a double data rate to reduce the interface size (e.g., number of pins) in half (e.g., 20 pins [19:0]). The pixel data may be divided into a first stream that includes the red/blue pixel data and a second stream that includes the green pixel data. For example, four RGBG pixels (in a horizontal line of the display) may include the sub-pixels R0, G0, B1, G1, R2, G2, B3, and G3. The buffer 560 divides the color streams according to the sub-pixel type and then shuffles the sub-pixels to send like sub-pixels consecutively in time. For example, the neighboring red sub-pixels R0 and R2 may be grouped with their corresponding green sub-pixels G0 and G1. Similarly, the neighboring blue sub-pixels B1 and B3 may be grouped with their corresponding green sub-pixels G2 and G3. In Step 555, the reordered sub-pixels are stored in the buffer 560 and sent to the HV chip via the interface 550 in their reordered sequence. In some embodiments, the HV chip may reverse the shuffling of the colors with a similar buffer embedded on the HV chip.

The shuffling of the colors by the buffer 560 may also reduce the amount of power used by the interface 550. As discussed above, the power consumed by the interface 550 is related to a signal toggling between different states (e.g., when the pixels toggle). When the interface 550 moves from a first sub-pixel of one color (e.g. blue) to a second sub-pixel of a different color (e.g. red), the output value changes (e.g., the pixel toggles). When the interface 550 moves from a first sub-pixel of one color (e.g. blue) to a second sub-pixel of the same color (e.g. blue), the signal is less likely to toggle and generally remains at a constant or similar level. Thus, reducing the power consumed by the interface 550.

Figure 6:
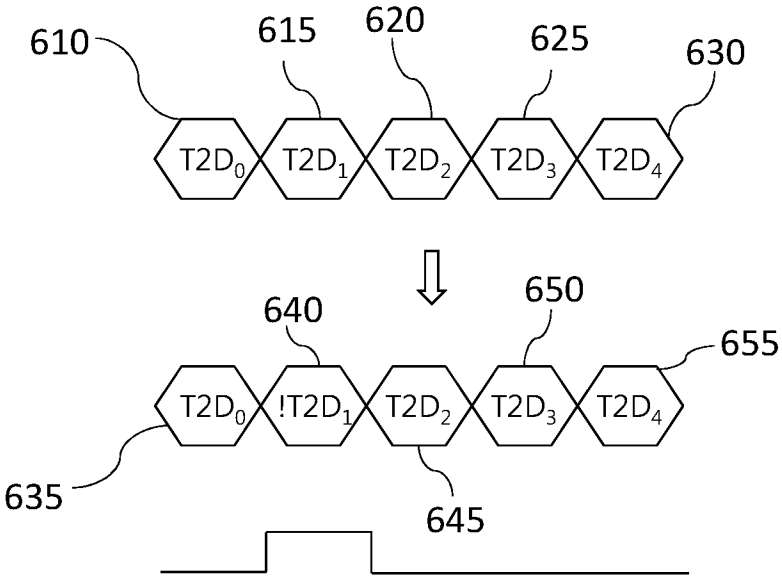
FIG. 6 is a diagram illustrating a peak power reduction encoding technique used by the display architecture according to an embodiment.

FIG. 6 is a diagram illustrating a peak power reduction encoding technique used by the display architecture according to an embodiment.

In various embodiments, the display architecture may support various encoding techniques to reduce peak interface power. Some of these encoding techniques may include transition encoding technique. For example, data bit inversion (DBI) may be employed by to reduce peak interface power. During DBI encoding, the system may reduce the amount of toggling by selectively inverting a portion of bits being sent in a sequence. For example, a data stream (or sequence) sent from the LV chip to the HV chip using the T2D interface (each discussed above) may include a sequence on the bus that begins with $T2D_0$ 610 and ends with $T2D_4$ 630 (where each portion of the sequence represents pixel data). The data stream may be DBI-encoded to create DBI-encoded sequence on the bus that begins with $T2D_o$ 635 and ends with $T2D_4$ 655. In various embodiments, one or more DBI pins may be added to each of the LV chip, HV chip, and T2D interface. For example, each color (e.g., sub-pixel) may have a dedicated DBI pin, or there may be one DBI pin for each set of pixel data (610-630). Furthermore, the encoding may be used between the LV chip and the T2D interface and/or between the T2D interface and the HV chip.

In various embodiments, the display architecture includes a single DBI pin for indicating that the value of a T2D bus at a time n has been inverted. In various embodiments, the LV chip may compare the DBI-encoded T2D bus output value at time 0, $T2D_o$ 610, with the input to the DBI encoder at time 1, $T2D_1$ 615. If more than half of the bits of the bus are transitioning from the T2D bus output value at time 0, $T2D_o$ 610 to the input to the DBI encoder at time 1, $T2D_1$ 615, then a DBI bit is asserted and the DBI-encoded T2D bus output value at time 1, $T2D_1$ 640, will be equal to the inverted input value at time 1, $T2D_1$ 615. This ensures that no more than half of the bits will be transitioning at the output of the DBI encoder. Each subsequent T2D bus output and input values may also be compared and inverted accordingly. Thus, the LV chip may send the DBI stream $T2D_0$ 635 and ends with $T2D_4$ 655 (with $T2D_1$ 640 inverted) along with the DBI signal 660 to the T2D interface.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

Features of the inventive concept and methods of accomplishing the same may be understood more readily by reference to the aforementioned detailed description of embodiments and the accompanying drawings. The aforesaid embodiments were described in more detail with reference to the accompanying drawings, in which like reference numbers referred to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of embodiments of the present disclosure may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

In the previous description, for the purposes of explanation, numerous specific details were set forth to provide a thorough understanding of various embodiments. It is apparent, however, that various embodiments may be practiced without these specific details or with one or more equivalent arrangements. Further, one of ordinary skills in the art would appreciate that various features of two or more embodiments described herein may be combined in any suitable manner without departing from the spirit or scope of the present disclosure. In other instances, well-known structures and devices are shown in block diagram form in order to avoid unnecessarily obscuring various embodiments.

It is understood that when an element, layer, region, or component was referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it is understood that when an element or layer was referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicated otherwise. It is further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the disclosure refers to "one or more embodiments of the disclosure." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

What is claimed is:

1. A display architecture comprising:

a display;

a low voltage integrated circuit manufactured using a first semiconductor manufacturing process and configured to:

receive a high speed input signal;

process the input signal to generate uncompressed pixel data;

reorder the uncompressed pixel data according to pixel color; and output the uncompressed pixel data; and a high voltage integrated circuit manufactured using a second semiconductor manufacturing process, wherein the first semiconductor manufacturing process is a smaller process node than the second semiconductor manufacturing process, and configured to:

receive the uncompressed pixel data;

reorder the uncompressed pixel data according to original pixel color order; and drive pixels in the display based on the uncompressed pixel data;

wherein the low voltage integrated circuit is configured to provide the uncompressed pixel data to the high voltage integrated circuit via a timing-to-driver (T2D) interface.

2. The display architecture of claim 1, wherein the high speed input signal comprises an encoded input signal.

3. The display architecture of claim 1, wherein the T2D interface comprises a parallel interface.

4. The display architecture according to claim 1, wherein the low voltage integrated circuit comprises an embedded memory manager (eMEM) and a processor.

5. The display architecture according to claim 4, wherein the processor comprises a Timing Controller Embedded Driver Integrated Circuit (TED) core.

6. The display architecture according to claim 4, wherein the embedded memory manager comprises at least one of an embedded Dynamic Random-Access Memory (eDRAM) or an embedded Magnetoresistive Random Access Memory (eMRAM).

7. The display architecture of claim 1, wherein:

the uncompressed pixel data comprises red-green-blue-green (RGBG) data, the low voltage integrated circuit further comprises a first buffer, and the high voltage integrated circuit includes a second buffer;

reordering the uncompressed pixel data according to the pixel color includes:

separating, at the first buffer, red/blue (R/B) pixel data of the RGBG data into a first color stream and green (g) pixel data of the RGBG data into a second color stream; and reordering, at the first buffer, the R/B pixel data of the first color stream such that same colors of the R/B pixel data appear consecutively; and outputting the uncompressed pixel data includes transmitting the first color stream and the second color stream to the second buffer in the high voltage integrated circuit.

8. The display architecture of claim 7, wherein reordering, the uncompressed pixel data according to original pixel color order includes: reordering, at the second buffer, the R/B pixel data of the first color stream such that the colors of the R/B pixel data appear in the original order.

9. A method for transmitting pixel data in a display comprising:

reordering, by a transmitter side of a low voltage integrated circuit manufactured using a first semiconductor manufacturing process, uncompressed pixel data according to pixel color;

transmitting, by the transmitter side, the uncompressed pixel data on a data bus;

receiving, by a receiver side of a high voltage integrated circuit manufactured using a second semiconductor manufacturing process, wherein the first semiconductor manufacturing process is a smaller process node than the second semiconductor manufacturing process, the uncompressed pixel data from the low voltage integrated circuit; and reordering, by the receiver side, the uncompressed pixel data according to original pixel color order, wherein the data bus comprises an unterminated connection at the receiver side.

10. The method according to claim 9, wherein the uncompressed pixel data comprises red-green-blue (RGB) data.

11. The method according to claim 9, wherein the uncompressed pixel data comprises red-green-blue-green (RGBG) data.

12. The method according to claim 11, wherein:

reordering, by the transmitter side of the low voltage integrated circuit manufactured using the first semiconductor manufacturing process, the uncompressed pixel data according to pixel color comprises:

separating, by a buffer in the transmitter side, red/blue (R/B) pixel data of the RGBG data into a first color stream and green (g) pixel data of the RGBG data into a second color stream; and reordering, by the buffer in the transmitter side, the R/B pixel data of the first color stream such that same colors of the R/B pixel data appear consecutively;

transmitting, by the transmitter side, the uncompressed pixel data on the data bus comprises transmitting, by the buffer in the transmitter side, the first color stream and the second color stream to a second buffer in the receiver side; and reordering, by the receiver side, the uncompressed pixel data according to original pixel color order comprises reordering, by the second buffer in the receiver side, the R/B pixel data of the first color stream such that the colors of the R/B pixel data appear in the original order.

13. The method according to claim 9 further comprising:

transition encoding uncompressed pixel data at the transmitter side;

transition signal to the receiver side; and decoding uncompressed pixel data at the receiver side according to the transition signal.

14. A method for transmitting uncompressed red-green-blue-green (RGBG) pixel data across an interface of a display comprising:

separating, by a buffer of a low voltage integrated circuit, red/blue (R/B) pixel data of the uncompressed RGBG pixel data into a first color stream and green (g) pixel data of the uncompressed RGBG pixel data into a second color stream;

reordering, by the buffer of the low voltage integrated circuit, the R/B pixel data of the first color stream such that same colors of the R/B pixel data appear consecutively;

transmitting, by the buffer of the low voltage integrated circuit, the first color stream and the second color stream to a receiver side of the interface;

carrying, by the interface, the first color stream and the second color stream from the receiver side of the interface to a transmitter side of the interface; and transmitting, by the transmitter side of the interface, the first color stream and the second color stream to a high voltage integrated circuit.

15. The method according to claim 14, further comprising:

storing, by the high voltage integrated circuit, the first color stream and second color stream in a buffer of the high voltage integrated circuit;

reordering, by the buffer of the high voltage integrated circuit, the R/B pixel data of the first color stream such that the colors of the R/B pixel data are in an original order;

driving, by the high voltage integrated circuit, the first color stream and the second color stream to a display.

16. The method according to claim 14, wherein the interface comprises a Timing-to-Driver (T2D) interface.

17. The method according to claim 14, wherein the low voltage integrated circuit comprises an embedded memory manager (eMEM) and a processor.

18. The method according to claim 17, wherein the processor comprises a Timing Controller Embedded Driver Integrated Circuit (TED) core.

19. The method according to claim 14, wherein the low voltage integrated circuit is manufactured using a first process and the high voltage integrated circuit is manufactured using a second process.

20. The method according to claim 19, wherein the first process is more advanced than the second process.

* * * * *